US007255118B2

(12) United States Patent
Vardy et al.

(10) Patent No.: US 7,255,118 B2
(45) Date of Patent: Aug. 14, 2007

(54) TILTING UMBRELLA

(75) Inventors: Daniel Vardy, Rotherham (GB); Michael Harold Bly, Huddersfield (GB)

(73) Assignee: Hoyland Fox Limited, Penistone Sheffield (GB)

( * ) Notice: Subject to any disclaimer, the term of this patent is extended or adjusted under 35 U.S.C. 154(b) by 120 days.

(21) Appl. No.: 10/506,774

(22) PCT Filed: Mar. 6, 2003

(86) PCT No.: PCT/GB03/00940

§ 371 (c)(1),
(2), (4) Date: Jun. 15, 2005

(87) PCT Pub. No.: WO03/073884

PCT Pub. Date: Sep. 12, 2003

(65) Prior Publication Data

US 2005/0236023 A1 Oct. 27, 2005

(30) Foreign Application Priority Data

Mar. 7, 2002 (GB) ..... 0205424.5

(51) Int. Cl.
*A45B 17/00* (2006.01)

(52) U.S. Cl. ..... 135/20.1

(58) Field of Classification Search ..... 135/20.1, 135/20.3, 909, 98; 403/103, 84, 87; 248/514
See application file for complete search history.

(56) References Cited

U.S. PATENT DOCUMENTS 3,145,720 A * 8/1964 Torii ..... 135/20.3
3,182,673 A 5/1965 Small
3,850,186 A 11/1974 Weber et al.
4,697,606 A 10/1987 Ma
5,029,596 A 7/1991 Tung et al.
5,086,797 A * 2/1992 Earnshaw et al. ..... 135/20.1
5,590,673 A * 1/1997 Earnshaw ..... 135/20.1
6,311,705 B1 * 11/2001 Ma ..... 135/20.3
6,516,820 B1 * 2/2003 Earnshaw ..... 135/20.1

FOREIGN PATENT DOCUMENTS

DE 130 141 C 4/1901
DE 498 232 C 5/1930

(Continued)

*Primary Examiner*—David Dunn
*Assistant Examiner*—Noah Chandler Hawk
(74) *Attorney, Agent, or Firm*—Antonelli, Terry, Stout & Kraus, LLP.

(57) ABSTRACT

An umbrella frame has a two-part shaft, having a lower portion (10), upon which a runner (12) is slidably mounted, and an upper portion (14). When assembled the upper portion (14) of the shaft is mounted on the lower portion (10) of the shaft by means which allow it to tilt with respect to the lower portion, when the runner is rotated after having opened the umbrella frame. With the frame in the open position the runner engages with a rotating element (34) having a helical thread (36). The thread engages with teeth (30) on a gear element (28) attached to the upper portion of the shaft. Rotation of the rotating element causes the teeth to ride in the thread, which causes the upper portion to tilt. This makes it possible for a user to tilt the umbrella simply by rotating the runner.

9 Claims, 3 Drawing Sheets

FOREIGN PATENT DOCUMENTS

| | | | |
|---|---|---|---|
| EP | 0 681 794 | A1 | 11/1995 |
| FR | 715.401 | A | 12/1931 |
| FR | 1.493.969 | A | 9/1967 |
| GB | 410 808 | A | 5/1934 |
| WO | WO99/56579 | | 11/1999 |

* cited by examiner

TILTING UMBRELLA

The present invention relates to an umbrella for use in protection against the sun, wind or rain, having a progressive tilting mechanism with which the top of the umbrella can be orientated into a required position; such umbrellas can be used as fishing umbrellas or caféparasols, for instance.

Prior art tilting mechanisms exist in which the tilting action takes place as the runner reaches its top position, i.e. when the umbrella is completely unfurled. At this point further movement of the runner along the shaft engages a further member associated with the shaft near the tilting joint, causing the tilt to be carried out. In most tilting umbrellas, such as for instance in U.S. Pat. No. 3,850,186 (Weber et al.), U.S. Pat. No. 4,697,606 (Ma) or U.S. Pat. No. 5,029,596 (Tung) the runner first slides on to the upper shaft part, and then tilts with it.

There also exist devices of the type shown in U.S. Pat. No. 3,182,673 and others by S. N. Small, where the tilt is above the runner. While these have been known for a long time they involve the disadvantage that the insertion of a considerable number of connecting parts into the shaft is problematic from the manufacturing point of view.

The applicant's earlier WO 99/56579 discloses a tilting umbrella wherein the tilting hinge is located above the runner and the tilting action is brought about by movement of the runner, as in the Small patents. However, in contrast to the Small patents the runner pushes a lever connected to and arranged outside the upper shaft part. This avoids the problem of having numerous connecting parts within the shaft and therefore is beneficial from a manufacturing perspective.

However, this umbrella and the Small patents suffer the problem that the tilting mechanism is dependent on the mechanism that opens the umbrella. Therefore, when the runner is in the position wherein the cover of the umbrella is fully unfurled, and the further movement of the runner is transformed into tilting of the umbrella, the tilting travel is against the cover tension, thereby requiring more effort from the user.

Embodiments of the present invention aim to provide an umbrella with a simple and easy-to-use tilting mechanism which overcomes these problems.

The present invention provides an umbrella frame comprising: a shaft having an upper portion and a lower portion, the upper portion being connected to the lower portion in such a way that the upper portion can tilt with respect to the lower portion; a runner slid ably mounted on the lower shaft; and mechanical linking means linking the runner to the upper portion of the shaft when the runner is in its upper location, in such a way as to cause the upper portion of the shaft to tilt when the runner is rotated about the shaft axis.

Preferably the mechanical linking means includes a rotatable element which can be engaged by the runner in its upper location so that when the runner is rotated on the lower portion of the shaft the rotatable element is rotated. Preferably also the rotatable element is in permanent drive connection with the upper shaft, so that the runner only has to engage in the direction of rotation, which simplifies the engagement.

The mechanical linking means may further comprise: a gear element, having one or more teeth, in the upper portion of the shaft; and a pivot block at the top of the lower portion for receiving the upper portion of the shaft in a tiltable manner; and the runner or the rotatable element may have a substantially helical thread engaging at least one of the teeth on the gear element, so that when the rotatable element is turned about the axis of the lower shaft portion, the teeth in the gear element cause the upper portion of the shaft to be tilted.

Preferably the rotating element engages with the runner when the runner is slid up the shaft to unfurl the umbrella, so that subsequent rotation of the runner rotates the rotating element and thus tilts the umbrella. The rotating element may engage with the runner with corresponding lugs and tabs, or by use of a cam.

The rotating element may be tubular, having the substantially helical thread on its inside surface, and may be located so that in the assembled state of the umbrella at least part of the pivot block is disposed inside the rotating element permanently, wherein the gear element is received in the pivot block in such a way that at least one of the one or more teeth protrudes outside the pivot block and engages with the substantially helical thread.

The rotating element may alternatively be a worm, located inside the pivot block.

According to another aspect of the invention there is provided a runner for use on an umbrella shaft, and a notch ring, wherein the notch ring is disposed on the runner and can rotate about the runner axis. Preferably the bearing part on the runner can be compressed to allow the notch ring to be assembled.

For a better understanding of the invention reference will now be made to the accompanying drawings, in which.

Figure 1:
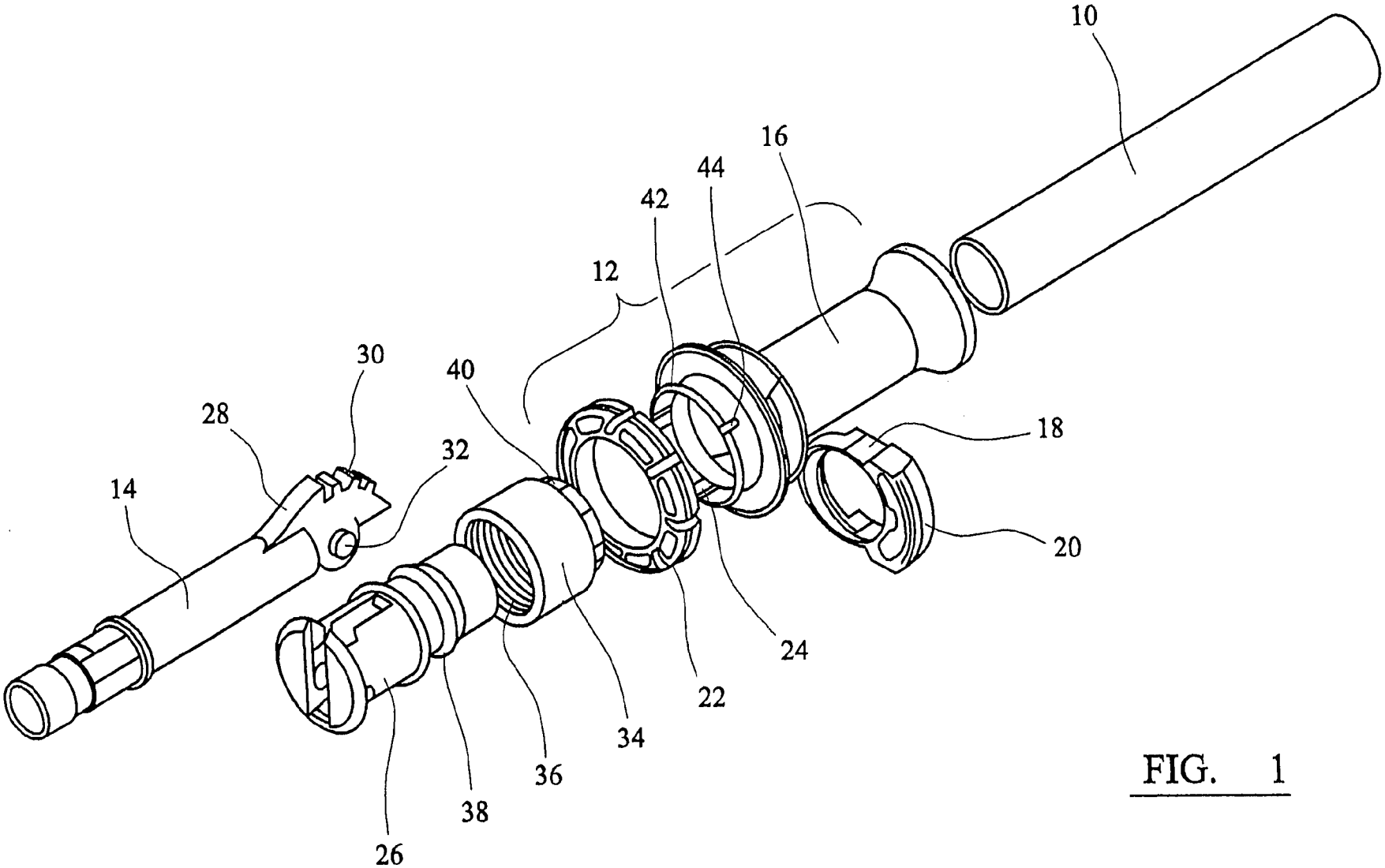
FIG. 1, shows an exploded view of an umbrella shaft.

FIG. 1 shows an exploded view of an umbrella shaft, having a lower portion 10, upon which a runner 12 is slid ably mounted, and an upper portion 14. For convenience the words "upper" and "lower" are used as labels for the parts, relating to the orientation of the umbrella in normal use; they are not to be construed as limiting in terms of location in space. In the umbrella of FIG. 1 when assembled the upper portion 14 of the shaft is mounted on the lower portion 10 of the shaft by means which allow it to tilt with respect to the lower portion.

The runner 12 comprises: a runner body 16, an annular locking member 18 having a button 20, and a notch ring 22. The end of the body 16 is annular, and on its inside surface there are one or more tabs 24 in the end nearer the upper part 14 of the shaft; the end of this body could also be cam-shaped. In the assembled umbrella of FIG. 1 ribs extend from a notch piece at the top of the upper portion 14 of the shaft; stretchers, likewise not shown, extend from notches on the notch ring 22 to corresponding points part-way along the ribs so as to hold the umbrella open when the runner is in its raised position.

In use the locking member 18 is located coaxially inside the runner body, the button 20 protruding through a suitable opening in the wall of the body 16. The notch ring 22 is located coaxially on the end of the body 16 nearer to the upper portion 14 of the shaft. All the parts shown except the lower shaft 10, which is usually of steel, can be made of suitable plastics materials.

In the assembled umbrella the upper portion 14 of the shaft is attached to the lower portion by means of a pivot block 26, which is fixed to, and forms the upper end of, the lower portion 10 of the shaft. The upper portion 14 of the shaft has a gear element 28, having teeth 30, at the end nearer the lower portion 10 of the shaft. The gear element 28 is mounted in an opening in the pivot block 26 by means of a bar 32, so that the upper portion 14 of the shaft can rotate in the (vertical) plane of the teeth 30, and so that some of the teeth 30 protrude from the opening. A tubular rotating element 34 having a helical thread 36 on its inside surface fits over the pivot block 26, so that at least some of the protruding teeth 30 engage with the helical thread 36 and the gear element, and hence the pivot end of the upper shaft portion, is held captive on the pivot block. Since some of the teeth always engage with the rotating element there is no need to engage the teeth to tilt the umbrella; the user only needs to engage the runner body with the rotating element. In order to arrange the teeth to be permanently engaged with the rotatable element it may initially be necessary to insert the gear element into the pivot block so that no teeth protrude, and then insert the pivot block into the rotatable element and move the gear element into its required position. A worm could be inserted into the pivot block 26 instead of using the rotating element 34; the runner would then be arranged to engage with the thread of the worm.

To open the assembled umbrella the runner 12 is slid up the lower portion 10 of the shaft towards the upper portion 14 of the shaft. By way of a bevel, or by depression of the button 20, deforming the locking member 18, the button passes over a lip 38 on the pivot block 26. The button then springs back or is released, preventing the locking member from returning over the lip 38, and thus preventing the runner 12 from sliding down the lower portion 10 of the shaft. The tabs 24 on the inner surface of the annulus at the top of the runner body engage with lugs 40 on the rotating element 34. The notch ring 22 is not rigidly attached to the runner body, as is the normal practice, but allows the runner body to rotate concentrically within it. The notch ring fits over the end of the runner body, and is held in place by a lip 42. The end of the runner body has one or more notches 44 to allow it to be compressed so that the notch ring can slide over the lip. The notch ring 22 is constrained by the stretchers to which it is attached and is thereby prevented from rotating. To close the umbrella the button 20 is depressed and the runner 12 again passes over the lip 38.

If the head of the umbrella is to be tilted the runner body 16 is rotated. This in turn causes the rotating element 34 to rotate by engagement of the lugs 40 with the tabs 24. The spaces between latter are circumferentially somewhat wider than the lugs, to make it easier to insert the lugs; hence there will usually be a short free travel distance before engagement. The rotation of the rotating element 34 causes the tracks in the helix 36 to ride over the teeth 30 that are engaged in the helix. The side of the gear element opposite the teeth should be a circular disc to allow free movement as the upper shaft pivots. Since the gear element 28 of the upper portion 14 of the shaft is limited to moving in the plane of the teeth, the motion of the helix 36 over the teeth 30 causes the teeth to move vertically; the gear element 28 thus rotates, causing the upper portion 14 of the shaft to tilt away from the vertical if the helix is turned in one direction. Thus, the head of the umbrella attached to the upper portion 14 of the shaft tilts. The maximum angle of tilt is governed by the number of teeth on the gear element 28, and the number of turns of the helix 36. For ease of use it is advantageous for the head of the umbrella to be tilted fully by giving the runner body 16 two to three turns.

Preferably the gear arrangement is self-locking so that the wind cannot cause (or undo) any tilting.

The tilting achieved by this method is progressive and has the advantage that any degree of tilt between the vertical and the maximum angle of tilt allowed by the umbrella can be obtained. Furthermore, the method of tilting is very simple and is achieved by using an easily accessible part of the umbrella.

To return the umbrella to its upright position the runner body 16 is rotated in the opposite direction. This causes the teeth 30 in the track of the helix 36 to move, causing the gear element to rotate in the opposite direction, and the upper portion 14 of the shaft to return to the vertical.

Figure 2:
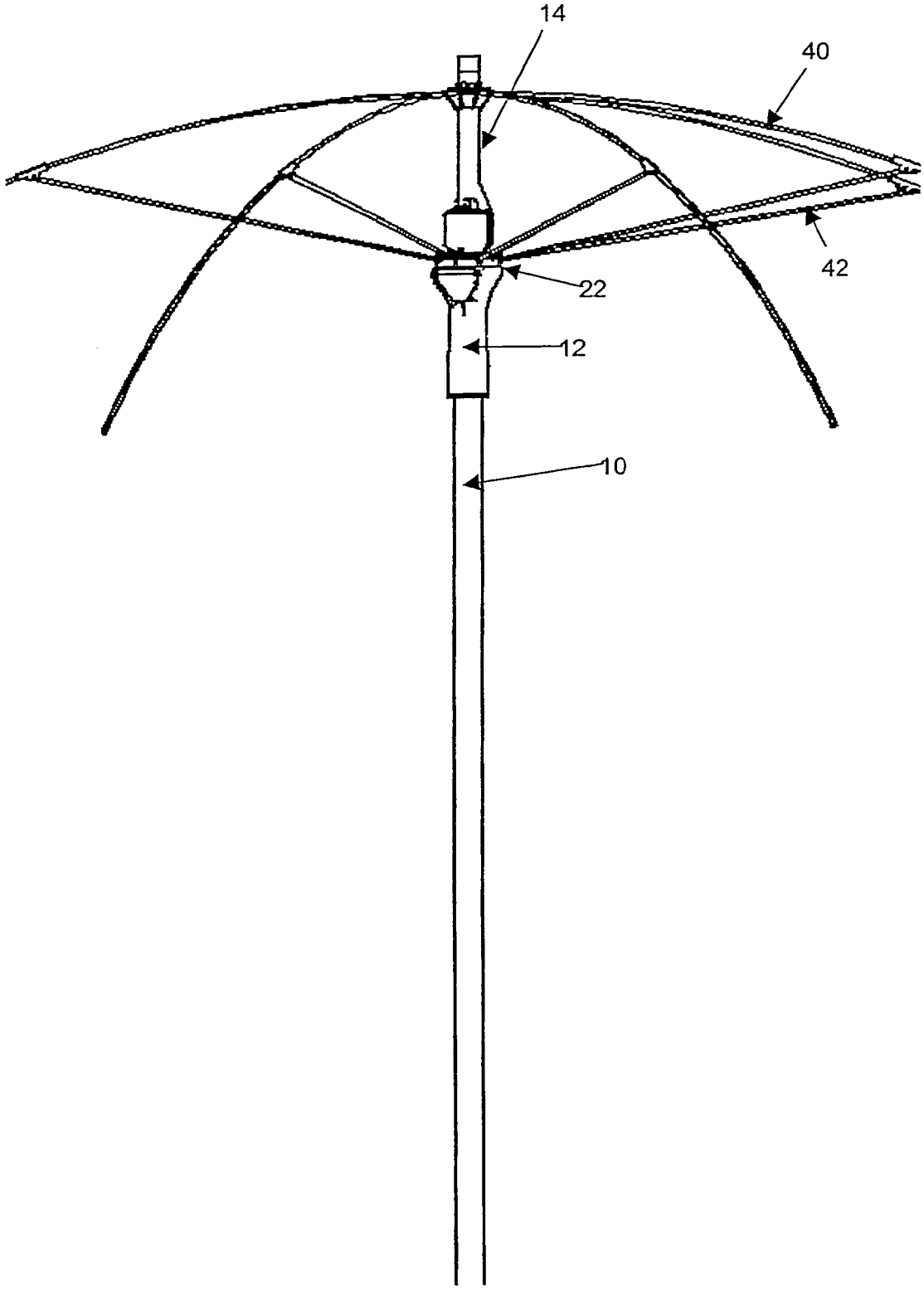
FIG. 2 shows an umbrella frame in an untilted state.

FIG. 2 shows an assembled umbrella frame, in its untilted position. In this diagram the upper portion of the shaft 14 is not tilted with respect to the lower portion 10 of the shaft. Ribs 40 extend from a notch piece at the top of the upper portion 14. Furthermore, stretchers 42 extend from notches on the notch ring 22 to points part-way along the ribs so as to hold the umbrella open when the runner is in its raised position. Typically, a cover (not shown) would be fitted over the ribs.

Figure 3:
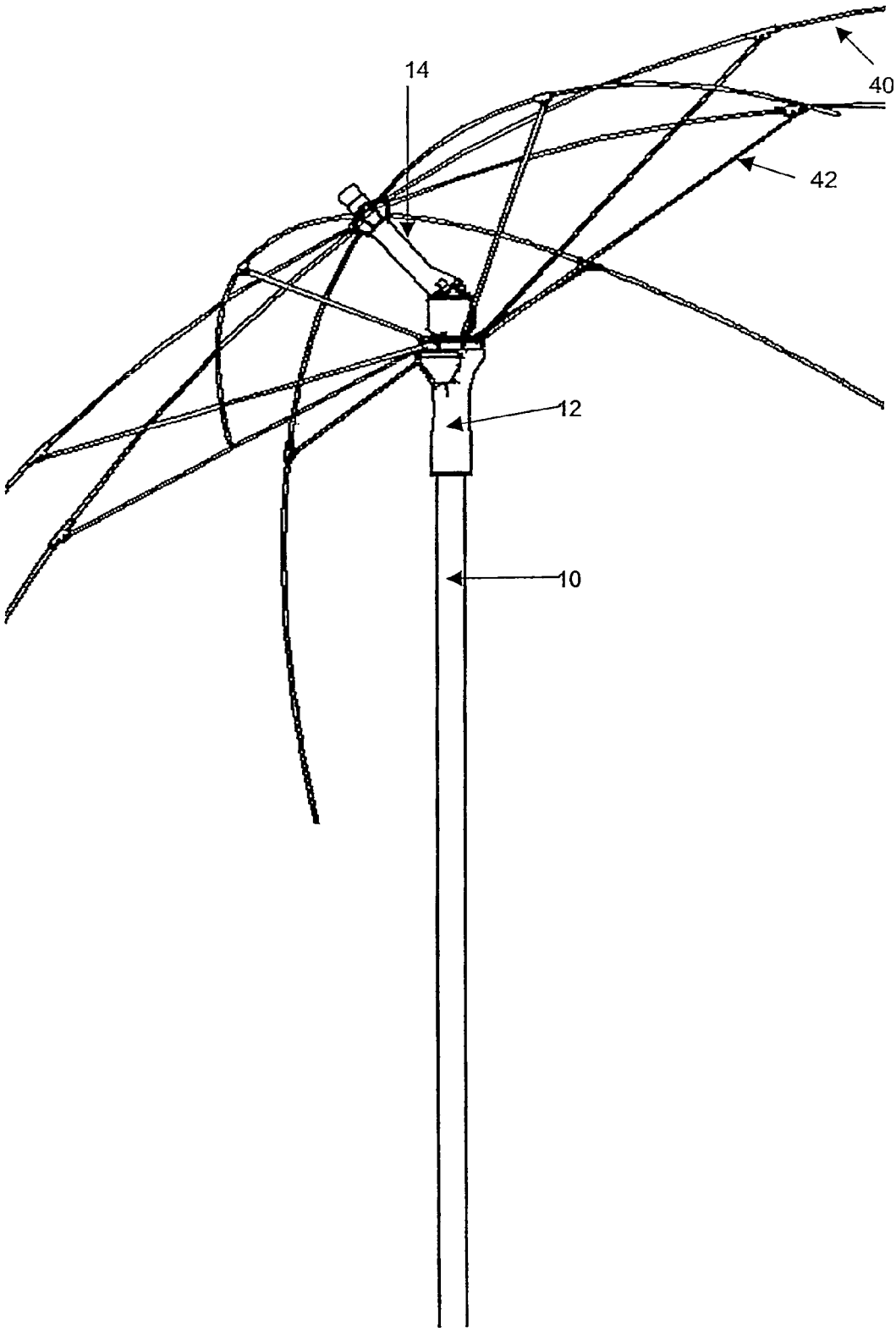
FIG. 3 shows an umbrella frame in a tilted state.

FIG. 3 shows an assembled umbrella frame, in its tilted position. The upper portion 14 of the shaft has been tilted with respect to the lower portion 10 by tilting the runner 12. Thus the ribs 40 attached to the shaft are also tilted.

The invention claimed is:

1. An umbrella frame comprising: a shaft having an upper portion and a lower portion, the upper portion being connected to the lower portion in such a way that the upper portion can tilt with respect to the lower portion; a runner mounted on the lower shaft portion so as to slide up and down to open and close the umbrella; and mechanical linking means, including a lower component associated with the runner, an upper component associated with the upper shaft portion, linking the runner to the upper portion of the shaft when the runner is in its upper location, and a rotating element rotatably mounted on the lower shaft portion and carrying the lower component which can be engaged by the runner as it is slid up the shaft so that when the runner is then rotated about the lower portion of the shaft the rotating element is rotated with it, tilting the upper portion, wherein the rotating element engages with the runner when the runner is slid up the shaft to unfurl a cover attached to the umbrella frame, so that subsequent rotation of the runner rotates the rotating element and thus tilts the umbrella cover.

2. An umbrella frame as claimed in claim 1, wherein the rotatable element is in permanent drive connection with the upper shaft for the tilt action.

3. An umbrella frame as claimed in claim 1, wherein the rotating element engages with the runner with corresponding lugs and tabs, or by use of a cam.

4. An umbrella frame as claimed in claim 1, wherein the upper component of the mechanical linking means comprises: a gear element, having one or more teeth, associated with the upper portion of the shaft; and a pivot block at the top of the lower portion for receiving the upper portion of the shaft in a tiltable manner; and the lower component of the linking means comprises a substantially helical thread engaging the teeth on the gear element, so that when the runner is turned about the axis of the lower shaft portion, the teeth in the gear-element cause the upper portion of the shaft to be tilted.

5. An umbrella frame according to claim 1, wherein the rotating element is a worm, located inside the pivot block.

6. An umbrella frame comprising: a shaft having an upper portion and a lower portion, the upper portion being connected to the lower portion in such a way that the upper portion can tilt with respect to the lower portion; a runner mounted on the lower shaft portion so as to slide up and down to open and close the umbrella; and mechanical linking means, including a lower component associated with the runner, an upper component associated with the upper shaft portion, linking the runner to the upper portion of the shaft when the runner is in its upper location, and a rotating element rotatably mounted on the lower shaft portion and carrying the lower component which can be engaged by the runner as it is slid up the shaft so that when the runner is then rotating about the lower portion of the shaft the rotatable element is rotated with it, tilting the upper portion, wherein the upper component of the mechanical linking means comprises: a gear element, having one or more teeth, associated with the upper portion of the shaft; and a pivot block at the top of the lower portion for receiving the upper portion of the shaft in a tiltable manner; and the lower component of the linking means comprises a substantially helical thread engaging the teeth on the gear element, so that when the runner is turned about the axis of the lower shaft portion, the teeth in the gear-element cause the upper portion of the shaft to be tilted, and wherein the rotating element is tubular, having the substantially helical thread on its inside surface, and is located so that in the assembled state of the umbrella at least part of the pivot block is disposed inside the rotating element permanently, and wherein the gear element is received in the pivot block in such a way that at least one of the one or more teeth protrudes outside the pivot block and engages with the substantially helical thread.

7. An umbrella frame comprising: a shaft having an upper portion and a lower portion, the upper portion being connected to the lower portion in such a way that the upper portion can tilt with respect to the lower portion; a runner mounted on the lower shaft portion so as to slide up and down to open and close the umbrella; and mechanical linking means, including a lower component associated with the runner, an upper component associated with the upper shaft portion, linking the runner to the upper portion of the shaft when the runner is in its upper location, in such a way as to cause the upper portion of the shaft to tilt when the runner is rotated, in which the runner includes a notch ring mounted rotatably about the runner axis.

8. A runner for use on an umbrella shaft comprising an upper portion and a lower portion, the runner including a runner body and a notch ring to which inner ends of the stretchers of the umbrella are to be attached, wherein the notch ring is disposed on the runner body and can rotate about an axis of the lower shaft portion so as to allow the runner body to be rotated with respect to the umbrella shaft; and tilting means comprising mechanical linking means for linking the runner to the upper portion of the shaft so that rotational motion of the runner with respect to the shaft causes the upper portion of the shaft to tilt with respect to the lower portion.

9. A runner according to claim 8, further, including a bearing part on the runner which can be radially compressed to allow the notch ring to be assembled.

* * * * *